US006315605B1

(12) United States Patent
Billman et al.

(10) Patent No.: US 6,315,605 B1
(45) Date of Patent: Nov. 13, 2001

(54) PRINTED CIRCUIT BOARD STIFFENER ASSEMBLY

(75) Inventors: Timothy B. Billman, Dover; John H. Weaver, Jr., Marietta, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/567,143

(22) Filed: May 9, 2000

(51) Int. Cl.[7] ..... H01R 13/66

(52) U.S. Cl. ..... 439/540.1; 439/79; 439/701; 361/809; 248/224.7

(58) Field of Search ..... 439/79, 701, 717, 439/80, 608, 540.1; 361/809, 808, 807; 248/220.21, 220.22, 224.7

(56) References Cited

U.S. PATENT DOCUMENTS

| | | | |
|---|---|---|---|
| 4,881,901 | 11/1989 | Mendenhall et al. | 439/65 |
| 5,158,471 | 10/1992 | Fedder et al. | 439/80 |
| 5,186,377 | 2/1993 | Rawson et al. | 228/37 |
| 5,198,279 | 3/1993 | Beinhaur et al. | 428/99 |
| 5,451,158 | 9/1995 | Lin et al. | 439/79 |
| 5,672,064 | 9/1997 | Provencher et al. | 439/79 |
| 5,676,569 | 10/1997 | Davis | 439/731 |
| 6,116,926 | 4/1999 | Ortega et al. . | |
| 6,123,554 | 5/1999 | Ortega et al. . | |

*Primary Examiner*—Paula Bradley
*Assistant Examiner*—Felix O. Figueroa
(74) *Attorney, Agent, or Firm*—Woodcock Washburn Kurtz Mackiewicz & Norris LLP

(57) ABSTRACT

A stiffener assembly for mechanically supporting the main body of an electrical connector to a circuit substrate, such as a daughterboard Printed Circuit Board (PCB). The PCB stiffener assembly is utilized to minimize bowing in the PC Board. The stiffener assembly includes a two-piece or split body having a top clamp and a bottom channel. A latch formed on the top clamp fits over and connectively engages a retention structure disposed on a rear surface of the connector housing. A bottom portion of the top clamp is disposed within the bottom channel. The bottom channel rests on the PCB and the legs of the bottom channel extend upward form the surface of the PCB. One leg of the bottom channel rest against the rear panel and fits under the retention structure. Fasteners pass through the PCB and the bottom channel and engage the top clamp thereby retaining the connector on the PCB. The stiffener assembly simultaneously aligns one or more connector modules to one another creating a one piece "mono-block" like effect while at the same time acting to stiffen the PCB thereby reducing any PCB bowing. The two-piece stiffener assembly allows for individual connector modules to be removed from the PCB by simply removing the top clamp portion of the PCB stiffener assembly. The stiffener provides a mechanism for mechanically supporting the main body of a connector module to a daughterboard PCB in a manner that is easy to manufacture and cost effective.

14 Claims, 5 Drawing Sheets

PRINTED CIRCUIT BOARD STIFFENER ASSEMBLY

RELATED APPLICATIONS

This application is related to pending U.S. Pat. No. 6,123,554, filed on May 28, 1999, which is hereby incorporated by reference.

FIELD OF THE INVENTION

This invention relates generally to electrical connectors for connecting a first circuit substrate, such as a daughter Printed Circuit Board (PCB) to a second circuit substrate, such as a backplane. More particularly, the present invention relates to a stiffener assembly and method for mechanically joining and stiffening one or more electrical connectors on a PCB.

BACKGROUND

Electrical connector pairs are commonly used in electronic equipment. Each pair functions to connect and route electrical signals between different PCBs. A typical connector pair consists of a plug, or header, and a receptacle, each including a plastic housing and multiple contact elements. The complimentary shaped plug and receptacle fit together, such that the electrical contacts of the plug are aligned with the electrical contacts of the receptacle. Each contact is provided with a tail portion that extends beyond the plastic housing to engage, for example, a plated through hole in the PCB. The plug and receptacle are attached to separate PCBs, such that the tail portions of each connector make contact with conductive traces formed on or in each PCB. In this manner, a connector pair completes an electrical circuit between the two PCBs. For instance, these type connectors have been used to electrically connect a daughterboard to another daughterboard, to a backplane board, or to other electrical circuitry. In a typical configuration, the receptacle is connected to the daughterboard while the plug is attached to the backplane.

One early limitation in the use of electrical connectors of this type was in maintaining tolerances for the proper alignment of the contact elements of each connector. This problem has been addressed through the development and use of multiple modules in a single connector. Since each individual module is smaller in size than the entire connector and plastic housing, it is easier to maintain manufacturing tolerances within acceptable limits, thereby ensuring that the plug and receptacle elements fit together properly and that the contacts establish an acceptable electrical connection.

The current United States industry standard for a two part modular connector system for electrically coupling a backplane to a daughter board is set out in specification EIA/IS-64 from the Electronic Industries Association. This specification delineates parameters for 2 mm, two part connectors for use with PCBs and backplanes. The international standard for these two part connectors is set out in IEC 1076-4-001 specification 48B.38.1. Both of these specifications define a free board (daughter board) connector that contains receptacle contacts and a fixed board (backplane or mother board) connector that contains pin contacts. The connector half containing receptacle contacts is commonly referred to as a socket connector, and the connector half containing pin contacts is commonly referred to as a header connector.

The use of stiffeners to help hold the individual connector modules together is known to maintain the correct tolerances and alignment between modules, and to help reduce bowing of the PCB. Alignment problems usually result from a difference in thermal expansion between the materials used in the modules and the PCB. When the assembly is heated during a soldering operation, the thermoplastic housing material of the connector can expand at a faster rate than the PCB material. A typical PCB is made from a composite of fiberglass/epoxy resin and contains copper traces with plated through holes or pads. Built-in residual stresses from the connector manufacturing and assembly processes are released by the heat generated during this soldering process. As a result, the components may not return to their original position after they have cooled down. This can result in misalignment of the connector tails when attached by the soldering process. This misalignment causes the more rigid connector housing to pull on the holes of the PCB through the metal contact tails, flexing the less rigid structure of the PCB to the alignment of the connector assembly. The longer the connector, the more this misalignment effect is compounded. The presence of numerous through holes in the PCB also introduces a less rigid area to the PCB which is more prone to flex during loading. Accordingly, stiffeners have become popular in these types of connector assemblies.

Traditional board stiffeners consist of an angled bar, shell, or U-shaped bar. The board stiffener is typically bolted or screwed to the PCB. In other applications, the stiffener is connected to both the connector and the PCB. Stiffeners are usually made from metallic material. These metal stiffeners have a much stronger stiffness when compared to the plastic housing of the connector or the composite material of the PCB. As a consequence, the stiffener helps to reduce the bowing effect. However, these board stiffeners also have several problems or design disadvantages.

One such problem is the increased assembly cost. Traditional stiffeners are difficult to manufacture in various lengths due to their designs and material, requiring expense retooling in the manufacturing process. In addition, traditional stiffeners do not allow for replacement/repair, or upgrading of an electrical connector on the PCB without complete disassembly and removal of the stiffener from all the connector assemblies.

Accordingly, a need still exists for providing means of connecting together and holding down various connectors, and of providing a means of stiffening the PCB to prevent bowing while still allowing individual connector assemblies to be removed from the PCB and also providing for the manufacture of various length board stiffener assemblies in a cost effective manner.

SUMMARY

The present invention is directed to a printed circuit board (PCB) stiffener, stiffener assembly, and method for mechanically supporting and aligning one or more electrical connectors on a PCB while at the same time stiffening the PCB. This invention solves the need of providing a means of manufacturing various length stiffener assemblies, joining together various connector assemblies, and also of providing the advantage of providing a mechanism for removal of one or more connector assemblies from the PCB without complete disassembly of the stiffener assembly from all the connector assemblies. The invention provides a means of stiffening the PCB to prevent bowing, while at the same time, conserving space or real estate on the PCB. The stiffener assembly also aligns the individual connector modules in a mono-block appearance.

The PCB stiffener includes a two-piece body having a top clamp and a bottom channel. The top clamp includes an inverted L-shaped body having a support leg and an engagement leg. The support leg is constructed to fit within the bottom channel and has a plurality of holes formed in a bottom surface for receiving fasteners to connect the top clamp to the PCB through openings formed in the bottom channel. The engagement leg includes a latch that is constructed to connectively engage a structure on the electrical connector thereby holding the stiffener to the connector.

The bottom channel includes a U-shaped body having a first leg and a second leg connected by a web member. The web member has a mounting surface constructed to mount on an upper surface of the PCB. The web member also includes a plurality of openings formed therein for receiving fasteners. The openings in the web member are constructed to correspond to the holes formed in the support leg of the top clamp. The first leg is adapted to form an alignment structure in conjunction with the latch. The alignment structure connectively engages a structure on the electrical connector thereby holding the stiffener to the connector. The second leg acts in conjunction with the first leg to form a channel. The channel is adapted to receive and support a lower portion of the support leg.

The PCB stiffener assembly includes an electrical connector, a stiffener, and a circuit substrate, such as a printed circuit board (PCB). The electrical connector includes a connector housing with a retention structure disposed thereon. Preferably, the retention structure is formed integral with the housing on a rear panel. The electrical connector has a plurality of electrical contact terminals disposed in the housing. The contact terminals are formed having tail portion that extend from a bottom mounting surface and a mating surface of the housing and are adapted for forming an electrical connection between a mating plug receptacle and traces on the PCB. The electrical connector can have mounting projection extending from a bottom mounting surface for connection to holes formed in the PCB for aligning and holding the electrical connector to the PCB.

The stiffener includes a two-piece body as described above. The two-piece body defines an alignment structure that is disposed about the retention structure of the electrical connector. The stiffener also includes a plurality of holes for receiving fasteners thereby attaching the stiffener to the PCB.

The PCB includes a plurality of contact pads, or plated through holes, adapted to receive tail portions extending from the electrical connector, thereby forming an electrical connection between the contact terminals and conductive traces in or on the PCB. The PCB can have holes formed therein for receiving mounting projections extending from a bottom mounting surface of the electrical connector.

This invention acts to reduce any PCB bowing. This strengthening and stiffening of the PCB are accomplished by connecting the stiffener to the connector and to the PCB. The substantially rigid structure of the stiffener and the positive mechanical connection of the stiffener to the PCB, allows the stiffener to directly strengthen and stiffen the PCB.

In accordance with a further aspect of the present invention, the stiffener acts to simultaneously align and join a plurality of connector modules to one other, creating a one-piece "mono-block" like effect. The stiffener may have a length sufficient to connect and align a plurality of connector modules.

The two-piece stiffener body allows for individual connector assemblies to be removed from the PCB by removing the top clamp. Since the top clamp and the bottom channel are preferably constructed from aluminum, the invention also allows for the PCB stiffener to be easily manufactured in various lengths by use of an extrusion die made to various lengths PCB stiffener assemblies in a cost effective manner.

BRIEF DESCRIPTION OF THE DRAWINGS

These and other features, aspects, and advantages of the present embodiment of the invention will become better understood with regards to the following description, appended claims, and accompanying drawings where:

DETAILED DESCRIPTION OF THE PREFERRED EMBODIMENTS

Figure 1:
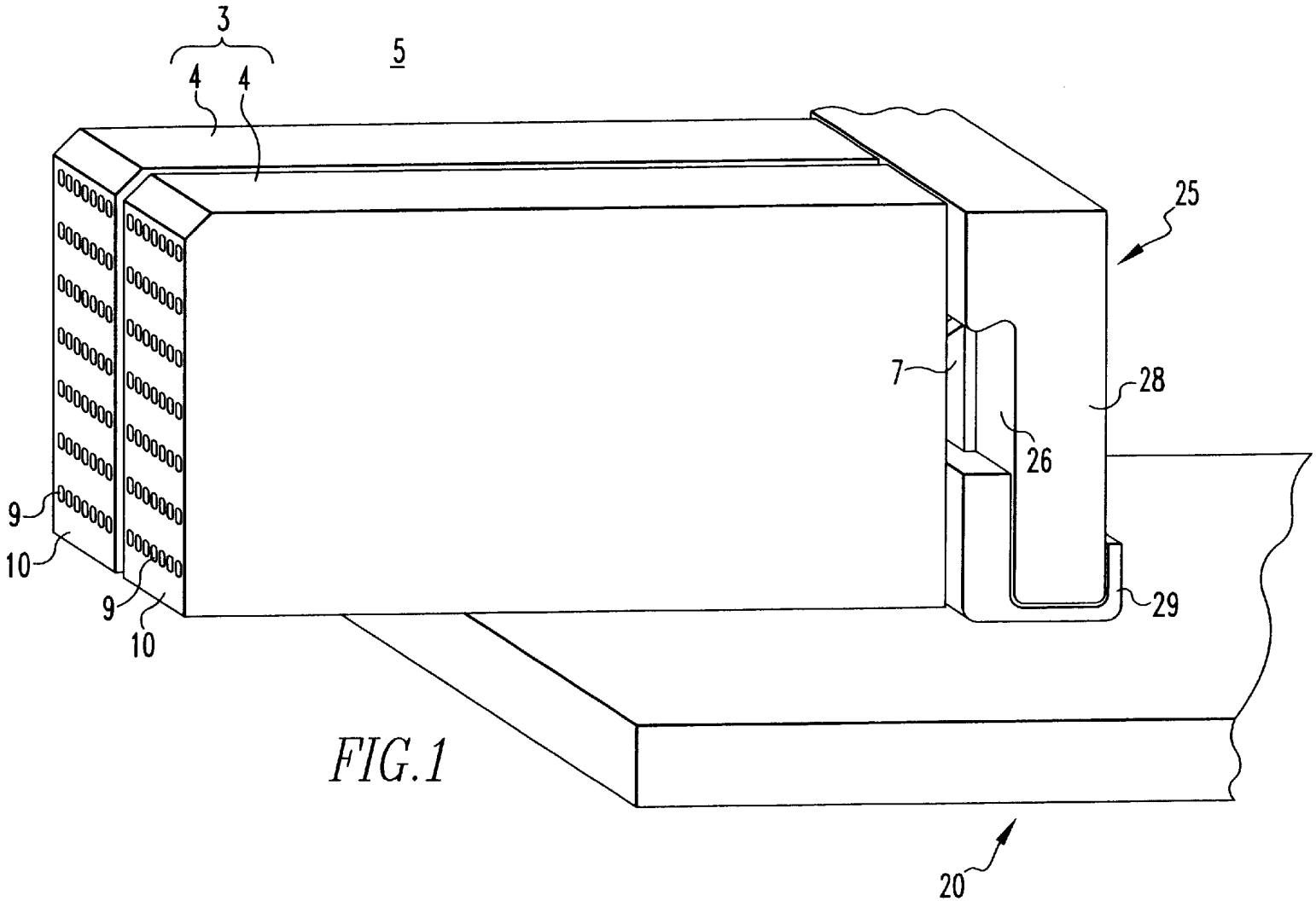
FIG. 1 is a perspective view of an exemplary embodiment of an electrical connector stiffener system of the present invention for connecting a PCB and one or more mating receptacle connectors.

Throughout the following detailed description similar reference numbers refer to similar elements in all the figures of the drawings. With reference to FIGS. 1 through 5, shown is an exemplary embodiment of a printed circuit board (PCB) stiffener assembly and a board stiffener connection system in accordance with the present invention. As shown, the stiffener engages a retention structure on a rear surface of the connector and also is connected to the PCB. The two-piece stiffener body allows for individual connector assemblies to be removed from the PCB by removing the top piece.

FIGS. 1 through 5 show an exemplary PCB stiffener connection system 5 constructed in accordance with the present invention. The PCB stiffener connection system 5 includes one or more electrical connectors 3, a stiffener 25, and a circuit substrate 20, such as a PCB. The electrical connector 3 is mechanically and electrically connected to the PCB 20. The stiffener 25 a two-piece construction that is mechanically connected to the electrical connector 3 and the PCB 20 thereby stiffening the PCB 20 and that allows individual connectors 3 to be more easily removed from the PCB 20 by only requiring removal of a top portion of the stiffener assembly 25.

Since a detailed discussion of the features of connector 3 are unnecessary for an understanding of the present invention, only a brief description follows. Connector 3 could be the connector described in pending U.S. Pat. No. 6,116,926, filed on Apr. 21, 1999, or any other suitable connector. As shown, each electrical connector 3 includes a plurality of connector sub-assembly modules 4. A series of connectors 3 positioned side-by-side on a PCB 20 for engagement by a stiffener 25 form a larger connector assembly or connection system 5, as shown in FIG. 1. The connection system 5 includes a plurality of electrical connectors 3 arranged adjacently and mountable on the PCB 20. Each electrical connector 3 has features for mechanically engaging the stiffener 25 and can have features for mechanically engaging the PCB 20. Each electrical connector 3 is adapted to be mechanically and electrically connected to a PCB 20, preferably using known techniques.

Figure 2:
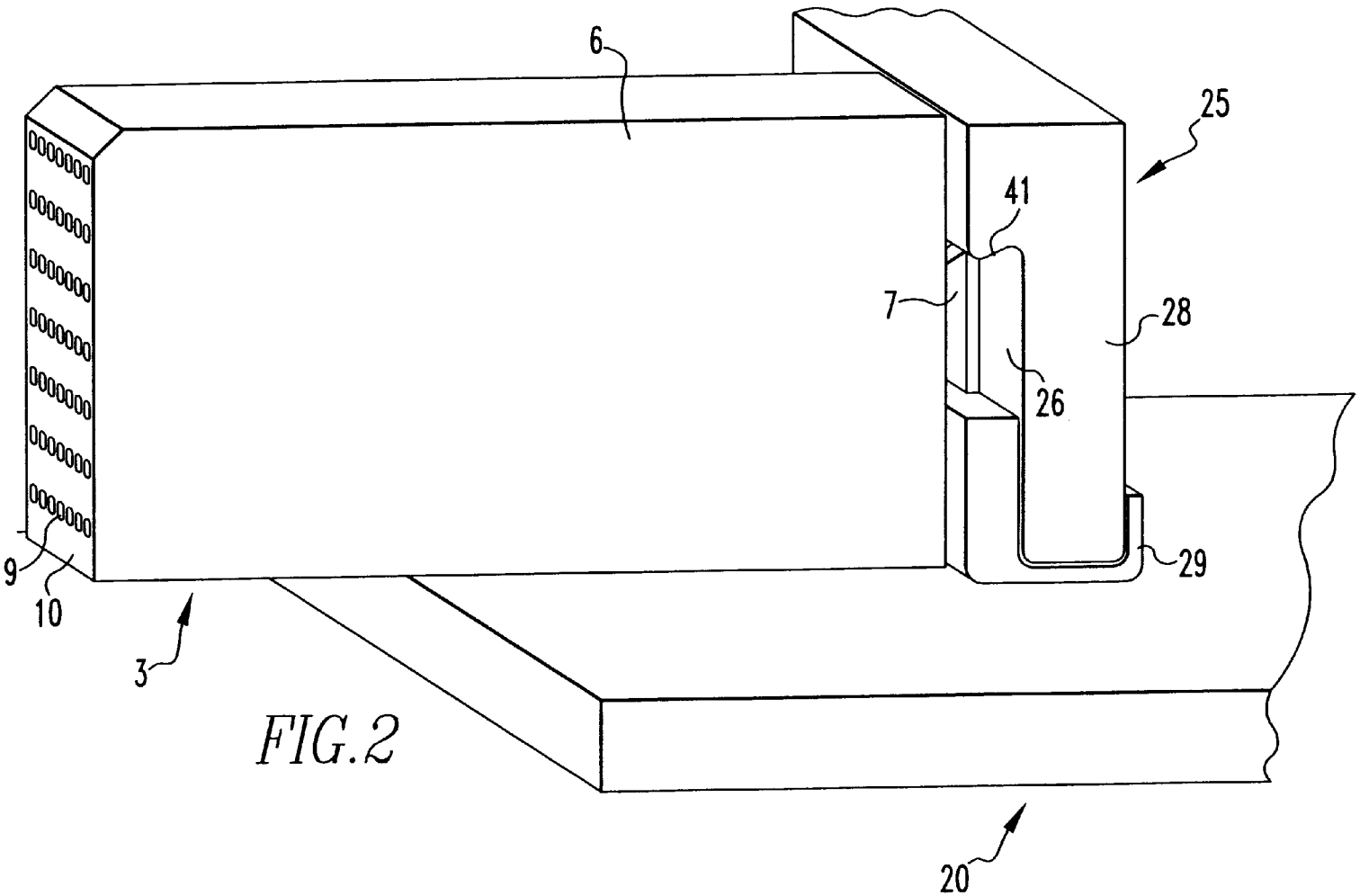
FIG. 2 is a perspective view of an exemplary embodiment of an electrical connector stiffener assembly of the present invention for connecting a PCB and a mating receptacle connector.
Figure 3:
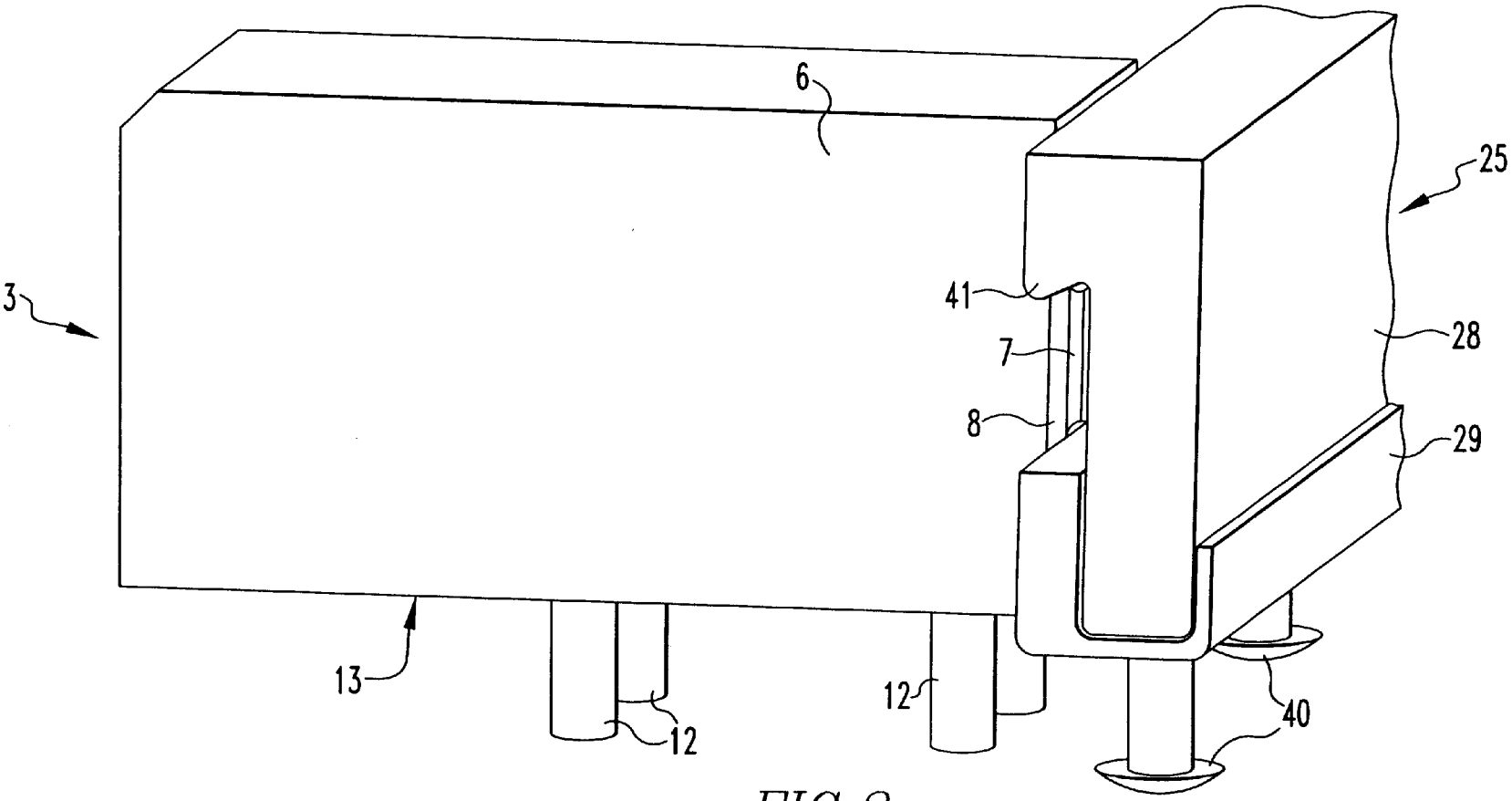
FIG. 3 is a reverse perspective view of an exemplary electrical connector stiffener assembly of FIG. 2.
Figure 4:
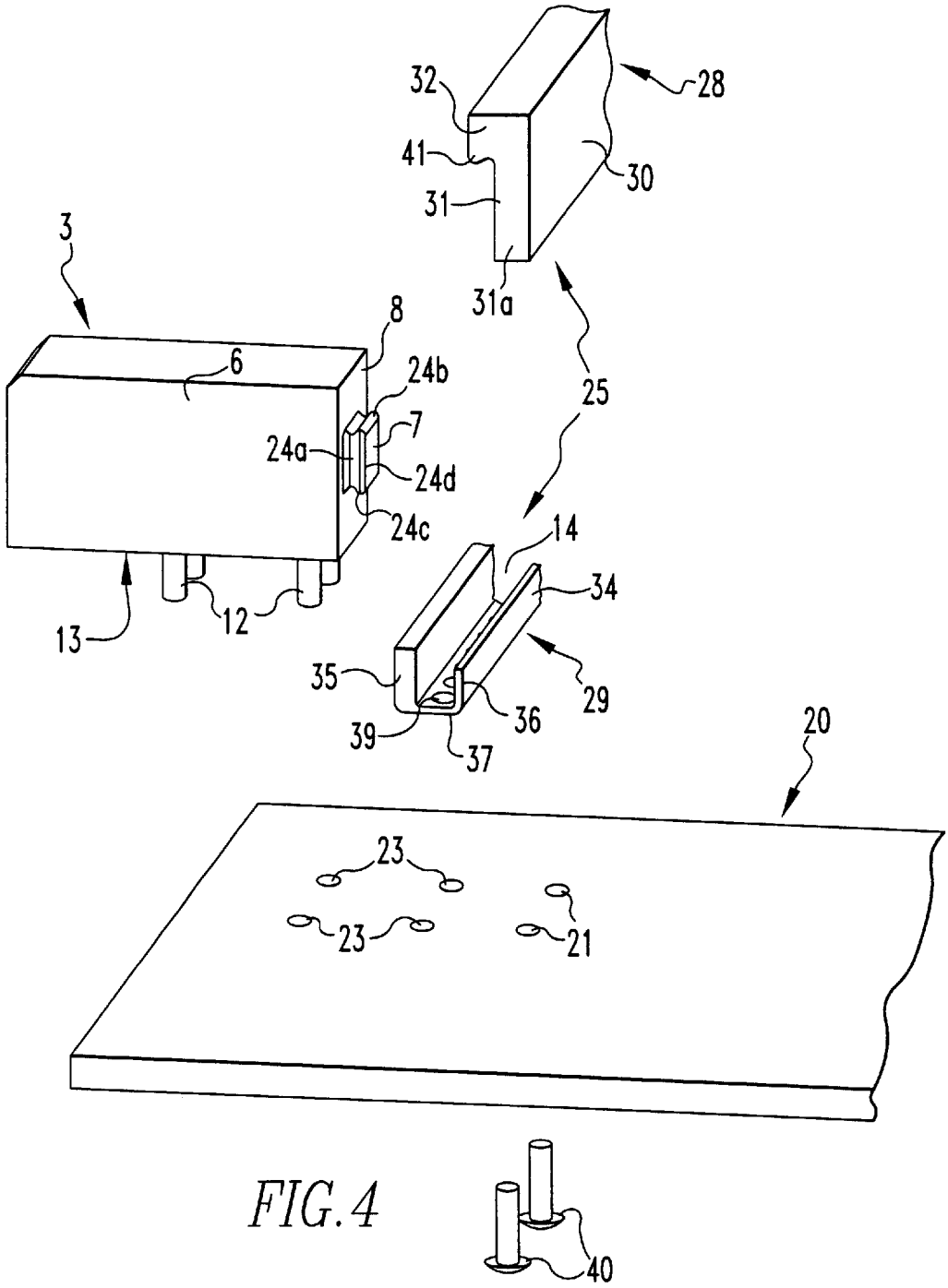
FIG. 4 is an exploded perspective view of the electrical connector stiffener assembly of FIG. 3.

Referring to FIGS. 2, 3, and 4, each connector 3 including a housing 6 having a retention structure 7 disposed thereon. Preferably, the retention structure 7 is formed integral with the housing 6 on a rear panel 8. The retention structure 7 is constructed to receive a corresponding alignment structure 26 on stiffener 25 thereby securing together one or more individual connectors 3 and stiffening the PCB 20.

As shown in FIGS. 1 through 3, housing 6 includes an arrangement of lead-in openings 9 formed in a front mating surface 10 that correspond to a plurality of electrical contacts (not shown). The contact terminals electrically connect PCB 20 to another PCB (not shown).

Housing 6 includes a bottom mounting surface 13, a rear panel 8, a plurality of contact terminals (not shown), and a retention structure 7. Rear panel 8 can have at least one retention structure 7 disposed proximate a center region. It should be understood that any other suitable connecting means may be employed to connect the stiffener 25 to the connector 3, such as pegs, dowel pins, screws, bolts, clips, interference fit, keys, slots, etc. Preferably, housing 6 is made from an electrically insulative material, such as a plastic or thermo plastic material.

Retention structure 7 is adapted for establishing a mechanical connection with stiffener 25. Preferably, retention structure 7 is designed to be received within and mechanically engage a corresponding alignment structure 26 on stiffener 25. Retention structure 7 includes a projection extending from the rear panel 8 of housing 6. Retention structure 7 may be formed separate from housing 6 and then fastened thereto, or preferably is formed integral with housing 6. As shown in FIGS. 2 and 4, retention structure 7 preferably has a dove-tail design having a series of protruded shaped flanges 24*a*. Protruded shaped flanges 24*a* include a top rib 24*b* and a bottom rib 24*c* connected by a central web 24*d*, as shown in FIG. 4.

Housing 6 can also include a plurality of mounting projections 12. Preferably, mounting projections 12 include a peg or dowel designs. Projections 12 may be formed separate from, or preferably are formed integral with housing 6, and extend from the bottom mounting surface 13. In a preferred embodiment, pegs 12 are sized to form an interference fit or press-fit with corresponding through holes 23 formed in PCB 20. The pegs 12 may be pressed into the PCB 20 using a vice or seating tool. Mounting projections 12 may form either a removable or non-removable attachment of the housing 6 to the PCB 20. The number of mounting projections 12 varies depending on the particular application and is predetermined to provide a sufficient retention force to support and hold the connector 3 to the PCB 20 while at the same time transposing the stiffening effect of the stiffener 25 to the PCB 20.

As shown in FIGS. 1 through 3, PCB 20 is provided with a plurality of holes 23 for receiving mounting projections 12 to form a mechanical connection therebetween. PCB 20 includes a plurality of through holes 21 for receiving a fastener device 40 to form a mechanical connection between the PCB 20 and the stiffener 25. PCB 20 also includes electrically conductive, plated through holes (not shown), or alternatively contact pads, adapted for establishing an electrical connection with terminal tails (not shown) extending from connector 3. PCB 20 can have suitable traces (not shown) disposed thereon for ground or transmitting signals.

As shown in FIGS. 1 through 3, the stiffener 25 is adapted to be connected to the assembled connector 3. The stiffener 25 exhibits a stiffening effect which is operative on the PCB 20 to help rigidify the PCB 20 and minimizes bowing of the PCB 20. Stiffener 25 can be attached directly to housing 6 using any suitable conventional attachment techniques, such as screws, clips, dowels, bolts, etc. Preferably, the stiffener 25 includes an alignment structure 26 which corresponds to and is attached about the retention structure 7 to mechanically engage and align one or more connectors 3 on the surface of the PCB 20 and also stiffen the PCB 20.

Preferably, stiffener 25 is made out of a material that is stiffer than the material of the PCB 20, such as a metallic material. More preferably, the stiffener 25 is an aluminum material. The use of a metal stiffener 25 is desired because of its stiffening and strength characteristics. However, it is within the scope of the invention for the stiffener 25 to be formed from other materials provided that the stiffener structure has a greater stiffness than the PCB structure.

As shown in FIGS. 1, 2, and 3, the stiffener 25 is connected directly to the connector 3 and the PCB 20. Stiffener 25 includes a two-piece or split body having atop clamp (e.g., a top portion) 28 and a bottom channel (e.g., a bottom portion) 29. Top clamp 28 and bottom channel 29 fit together to form alignment structure 26. The alignment structure 26 is constructed to correspond to and fit about the retention structure 7. The two-piece or split body design provides a mechanism for removing one or more connector assemblies 3 from the PCB 20 without complete disassembly of the stiffener from the connector system 5.

Figure 5:
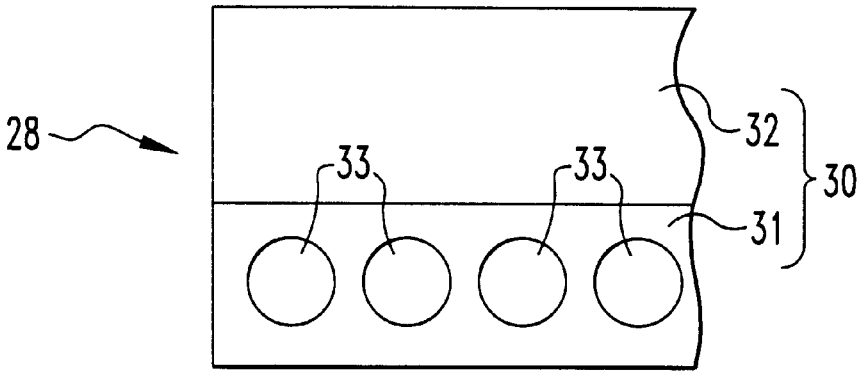
FIG. 5 is a bottom view of the exemplary top clamp of FIG. 2.

As shown in FIGS. 4 and 5, top clamp 28 includes an inverted L-shaped body 30 having a support leg 31 and an engagement leg 32. Support leg 31 has a lower portion 31*a* which is adapted to be received within bottom channel 29. The lower portion 31*a* has one or more holes 33 formed therein for forming a mechanical connection between the stiffener 25 and the PCB 20. Preferably, holes 33 arc threaded holes. One or more holes 33 preferably correspond to through holes 21 formed in the PCB 20. Engagement leg 32 includes a latch 41 formed at its distal end. Latch 41 forms a top section of alignment structure 26. Latch 41 is adapted to fit over and engage the top rib 24*b* of the protruding shaped flange 24*a* of retention structure 7.

Referring to FIG. 4, bottom channel 29 comprises a central web member 37 disposed on the PCB 20 and having one or more legs extending upward. Preferably, bottom channel 29 includes a U-shaped body 34 having a first leg 35 and a second leg 36 connected by central web member 37. First leg 35, a second leg 36, and central web member 37 define a channel 14 therebetween which is adapted to receive support leg 31.

First leg 35 forms a bottom portion of alignment structure 26. First leg 35 is adapted to fit flush against a portion of rear panel 8 and also fits under and engages the bottom rib 24*c*. The distal end of first leg 35 can be formed to fit within the bottom rib 24*c*. For example, the distal end of first leg 35 can be formed having a latch mechanism (not shown) similar to the latch 41 of top clamp 28. Preferably, the width of first leg 35 is predetermined to correspond to the distance that retention structure 7 extends outward from the rear panel 8.

Second leg 36 and central web member 37 preferably have a thinner width than first leg 35. Central web member 37 is disposed on the PCB 20 and includes one or more clearance openings 39 which preferably correspond to the holes 33 in top clamp 28 and the through holes 21 in the PCB 20.

A plurality of fasteners 40 are provided for connecting the stiffener 25 to the PCB 20, thereby aligning the connectors 3 on the PCB 20 and also stiffening the PCB 20. Preferably, the fasteners 40 pass through the through holes 21 formed in the PCB 20, the one or more clearance openings 39 formed in the central web member 37, and connectively engage the one or more holes 33 in the top clamp 28. More preferably, the fasteners 40 include mounting screws that pass through through holes 21, clearance openings 39, and connectively engage threaded holes 33.

Stiffener 25 is constructed such that alignment structure 26 corresponds to retention structure 7. Preferably, latch 41 fits over retention structure 7 from the top and first leg 35 fits under retention structure 7 such that retention structure 7 is structurally contained within alignment structure 26. This design forms a snug or an interference fit of the stiffener 25 to the retention structure 7.

Referring to FIG. 4, the exemplary PCB stiffener assembly can be assembled by first mounting one or more connectors to a PCB. The bottom channel can then be mounted on the PCB, preferably flush to the rear of the connector housing. This helps to minimize the amount of PCB space utilized, as well as to help capture the dovetail of the retention structure. The clearance openings (e.g., holes) in the bottom channel should be aligned to the holes in the PCB during this step. The top clamp can then be assembled such that the lower portion of the support leg fits within the channel of the bottom channel and the latch of the engagement leg fits over the top of the dovetail retention structure. The threaded holes in the support leg can then be aligned with the clearance holes of the bottom channel and the through holes in the PCB. Fasteners (e.g., threaded screws) can then be inserted from the bottom of the PCB to attach the stiffener assembly to the PCB.

Preferably, each electrical connector 3 has a relatively small size in relation to the completed larger electrical connector system 5 which typically includes a plurality of electrical connectors 3 that are aligned and connected together. Stiffener 25 is preferably used to assemble individual connectors 3 together by positioning the electrical connectors 3 together for engagement by the stiffener 25. The same size or various sized connectors 3 may be joined together by a single stiffener 25 merely by ensuring that a common size of retention structure 7 is used on all connectors 3.

It is preferred that the attachment of the stiffener assembly 25 to the PCB 20 have sufficient strength such that the characteristics of the stiffener 25 arc transferred to the PCB 20, thereby stiffening the PCB 20. The interaction of stiffener 25 and housing 6 acts to organize and align the connectors 3 on the PCB 20. Stiffener 25 also functions to align, stiffen, and hold a plurality of connectors 3 together to form a mono-block like appearance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connection system, mountable on a circuit substrate having a plurality of through holes formed therein, said connection system comprising:

a plurality of electrical connectors arranged adjacently on said circuit substrate, each including a housing having a retention structure thereon, wherein said retention structure extends from a rear panel of said housing;

a stiffener having a two-piece body defining an alignment structure corresponding to said retention structure for securing said connectors together, wherein said alignment structure is constructed to receive and fit about said retention structure; and wherein said two-piece body allows for removal of individual electrical connectors from said circuit substrate by removing a top portion of said stiffener.

2. The connection system as recited in claim 1, wherein said two-piece body further comprises a top clamp and a bottom channel.

3. The connection system as recited in claim 2, wherein said top clamp comprises a latch adapted for connectively engaging said top rib.

4. The connection system as recited in claim 2, wherein said top clamp includes one or more holes adapted for mechanically connecting said stiffener to said PCB.

5. The connection system as recited in claim 2, wherein said bottom channel comprises a substantially flat web member having one or more clearance openings formed therein and one or more legs extending upward from said web member.

6. The connection system as recited in claim 2, wherein said one or more legs comprise a first leg and a second leg defining a channel therebetween, said channel being constructed to receive said support leg.

7. The connection system as recited in claim 1, wherein said retention structure has a dovetail shape.

8. The connection system as recited in claim 7, wherein said retention structure further comprises a series of protruded shaped flanges having a top rib and a bottom rib connected by a central web.

9. The connection system as recited in claim 1, further comprising a plurality of fasteners for connecting said stiffener to said PCB.

10. The connection system as recited in claim 9, wherein said fasteners pass through said through holes in said PCB and said one or more clearance openings in said bottom channel, and connectively engage said one or more holes in said top clamp.

11. The connection system as recited in claim 9, wherein said fasteners comprise threaded mounting screws and said holes in said top clamp comprise threaded holes.

12. An electrical connector stiffener assembly for aligning and holding one or more electrical connectors on a printed circuit board (PCB) and for stiffening said PCB, said stiffener assembly comprising:

one or more electrical connectors comprising a housing having a retention structure disposed thereon and a plurality of contact terminals disposed therein, wherein said retention structure extends from a rear panel of said housing;

a two-piece stiffener comprising a top clamp and a bottom channel defining an alignment structure therebetween, wherein said alignment structure is adapted to fit over said retention structure to align and hold said electrical connectors on said PCB; and wherein one or more of said electrical connectors can be removed from said PCB by removing said top clamp.

13. The electrical connector stiffener assembly as recited in claim 12, further comprising a plurality of fasteners for connecting said stiffener to said PCB.

14. An electrical connector for use in establishing an electrical connection with a printed circuit board (PCB), said connector comprising:

a plurality of connector modules comprising a housing having a plurality of electrical contact terminal disposed therein, a rear panel, a retention structure formed on said rear panel, said connector module being adapted for forming a mechanical and electrical connection to said PCB; and a stiffener having a two-piece body having a top half and a bottom half that define an alignment structure when coupled together, said alignment structure being adapted to receive said retention structure, said split body being adapted for establishing a mechanical connection between said connector module and said PCB for allowing removal of one or more modules by removing said top half of said stiffener only.

* * * * *